US010396428B2

(12) United States Patent
Daniel et al.

(10) Patent No.: US 10,396,428 B2
(45) Date of Patent: Aug. 27, 2019

(54) BEAM SHAPING ANTENNA FOR LAMINATED GLASS

(71) Applicant: Palo Alto Research Center Incorporated, Palo Alto, CA (US)

(72) Inventors: George Daniel, Mountain View, CA (US); Armin R. Völkel, Mountain View, CA (US); Bernard D. Casse, Saratoga, CA (US)

(73) Assignees: PALO ALTO RESEARCH CENTER INCORPORATED, Palo Alto, CA (US); AGC AUTOMOTIVE AMERICAS R&D, INC., Ypsilanti, MI (US)

( * ) Notice: Subject to any disclaimer, the term of this patent is extended or adjusted under 35 U.S.C. 154(b) by 181 days.

(21) Appl. No.: 15/585,969

(22) Filed: May 3, 2017

(65) Prior Publication Data

US 2018/0323492 A1 Nov. 8, 2018

(51) Int. Cl.

| | |
|---|---|
| ***H01Q 7/00*** | (2006.01) |
| ***H01Q 9/16*** | (2006.01) |
| ***H01Q 1/12*** | (2006.01) |
| ***H01Q 3/44*** | (2006.01) |
| ***H01Q 21/29*** | (2006.01) |
| ***H01Q 21/06*** | (2006.01) |
| ***H01Q 15/00*** | (2006.01) |
| *H01Q 1/38* | (2006.01) |
| *H01Q 9/28* | (2006.01) |

(52) U.S. Cl.

CPC ..... *H01Q 1/1271* (2013.01); *H01Q 3/446* (2013.01); *H01Q 15/0086* (2013.01); *H01Q 21/062* (2013.01); *H01Q 21/29* (2013.01); *H01Q 1/38* (2013.01); *H01Q 9/285* (2013.01)

(58) Field of Classification Search

CPC ..... H01Q 1/12; H01Q 19/10; H01Q 19/108; H01Q 1/32; H01Q 1/42; H01Q 1/422; H01Q 1/44; H01Q 21/06; H01Q 21/062; H01Q 21/24; H01Q 1/1271; H01Q 3/44; H01Q 3/446; H01Q 21/29; H01Q 15/0086

See application file for complete search history.

(56) References Cited

U.S. PATENT DOCUMENTS 4,768,037 A * 8/1988 Inaba ..... B32B 17/10 343/713
5,471,222 A * 11/1995 Du ..... H01Q 1/1285 343/713

(Continued)

FOREIGN PATENT DOCUMENTS

DE 102008002318 A1 1/2009
KR 101345764 B1 1/2014

OTHER PUBLICATIONS

Extended European Search Report dated Aug. 14, 2018 for European Patent Application No. 18166852.6.

*Primary Examiner* — Tho G Phan
(74) *Attorney, Agent, or Firm* — Shun Yao; Park, Vaughan, Fleming & Dowler LLP

(57) ABSTRACT

An apparatus including an antenna, a first split ring resonator, and a second split ring resonator disclosed. The first split ring resonator located on a first side of the antenna, wherein the first split ring resonator is magnetically coupled to the antenna. The second split ring resonator located on a second side of the antenna, wherein the second split ring resonator is magnetically coupled to the antenna.

19 Claims, 4 Drawing Sheets

(56) References Cited

U.S. PATENT DOCUMENTS

| | | | | |
|---|---|---|---|---|
| 6,097,345 | A * | 8/2000 | Walton | H01Q 1/1271 343/700 MS |
| 7,471,247 | B2 * | 12/2008 | Saily | H01Q 1/523 343/700 MS |
| 9,620,835 | B2 * | 4/2017 | Fackelmeier | G01R 33/3415 |
| 9,742,065 | B2 * | 8/2017 | Blumberg, Jr. | H01Q 1/2225 |
| 9,912,050 | B2 * | 3/2018 | Manry, Jr. | H01Q 1/523 |
| 2008/0291097 | A1 | 11/2008 | Fukushima et al. | |

* cited by examiner

BEAM SHAPING ANTENNA FOR LAMINATED GLASS

BACKGROUND

A variety of vehicles, such as automobiles and aircraft, carry radio equipment to send or receive signals with other devices. The vehicles may include antennas that are integrated into the vehicle or attached to the vehicle. To communicate with the other devices, the radio equipment may be connected to antennas. The vehicles may include objects that interfere with the radio device sending and receiving the signals.

BRIEF DESCRIPTION OF THE DRAWINGS

The present disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1A:
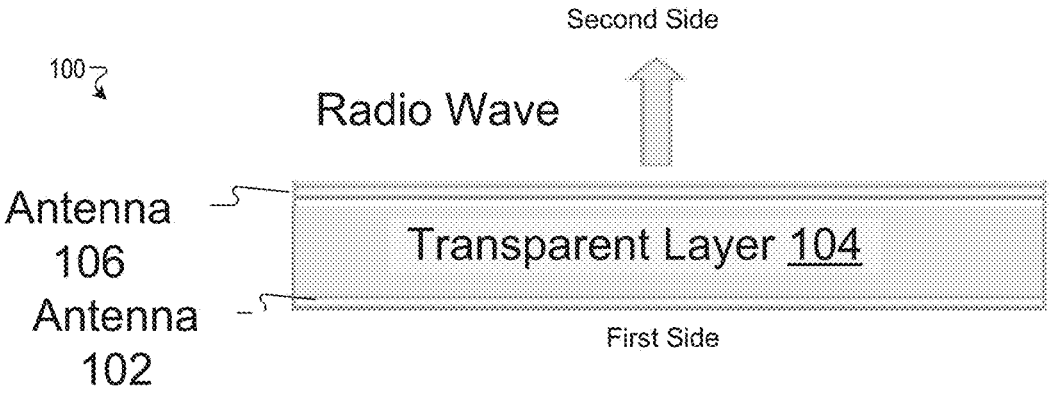
FIG. 1A illustrates an antenna structure that includes a first antenna element and a second antenna element, according to an implementation.

In the following description, various aspects of the illustrative implementations will be described using terms commonly employed by those skilled in the art to convey the substance of their work to others skilled in the art. However, it will be apparent to those skilled in the art that the present disclosure may be practiced with only some of the described aspects. For purposes of explanation, specific numbers, materials, and configurations are set forth in order to provide a thorough understanding of the illustrative implementations. However, it will be apparent to one skilled in the art that the present disclosure may be practiced without the specific details. In other instances, well-known features are omitted or simplified in order not to obscure the illustrative implementations.

Vehicles, such as automobiles and aircraft, may carry radio equipment to send or receive signals. The radio equipment may include antennas to send and receive the signals. Conventionally, the antennas for the vehicles are mounted to an outer surface of the vehicle. For example, an automobile may include a whip antenna or a fin antenna mounted to the body of the vehicle to send or receive signals. However, the whip antenna or the fin antenna may be unattractive and a vulnerable protruding feature on the roof of a vehicle. Additionally, a performance of the whip antenna or fin antenna may deteriorate as materials, such as dirt, build up on the whip antenna or the fin antenna.

Alternatively, the vehicle may include a window antenna that is attached to or integrated into a window of the vehicle. The window of the vehicle may offer protection from the obstacles and may be removed from surroundings metal objects that may interfere with the antenna. The window antenna may include conductive strips located on the glass surface of die window. The conductive strips may be arranged in a pattern as an antenna to send and receive signals from the radio equipment.

A conventional window antenna is a planar dipole antenna. The planar dipole antenna may be limited by type and direction of the radiation pattern. For example, the radiation pattern of the planar dipole antenna may be a toroidal pattern. When the planar dipole antenna is embedded in a windshield that is swept back at approximately a 45 degree angle, the radiation pattern of a signal may be directed toward the sky at a 45 degree angle. When the radio equipment is a smartphone that communicates with antennas of a tower mounted base station that are typically 100 meters or less above the ground, the from the planar dipole antenna may substantially miss the antenna at the base station.

The present disclosure addresses the above-mentioned and other deficiencies by providing for a window antenna with a beam-shaped radiation pattern to direct a signal, transmitted from the window antenna, in a given direction. The window antenna may include a dipole antenna element and resonators that control a radiation pattern of the signal. The window antenna may shape the beam to increase a gain of the antenna and reduce a signal loss of the antenna. The beam may be a radiation pattern of the signal.

FIG. 1A illustrates an antenna structure 100 that includes a first antenna element 102 and a second antenna element 106, according to an implementation. The first antenna element 102 may be connected to a first side of a transparent layer 104. The second antenna element 106 may be connected to a second side of a transparent layer 104. The first antenna element 102 and the second antenna element 106 may electromagnetically be coupled together to form the antenna structure 100 that may transmit signals at a defined angle, as discussed below.

The transparent layer 104 may be a layer of glass material, plastic material, polymethyl methacrylate material (such as Plexiglass™), and so forth. For example, the transparent layer 104 may be a glass material that relatively low loss and has a stable permittivity. In one example, the transparent layer 104 may be relatively thin, such as 4 millimeters (mm) thick.

In one implementation, the antenna structure 100 may be part of a window of a vehicle, such as a car, a truck, a bus, a train, and so forth. For example, the antenna structure 100 may be part of a layer of glass used in a windshield, backlight, side window, or skylight of a vehicle. In another implementation, the antenna structure 100 may be part of a window in an office building or a house. In another implementation, the antenna structure 100 may be part of a window in an aircraft, such as an airplane or helicopter. In another implementation, the antenna structure 100 may be part of a visor in a helmet.

The transparent layer 102 can enable an individual to see through the transparent layer 102 from a first side of the transparent layer 102 to a second side of the transparent layer 102. For example, the transparent layer 102 may be part of a windshield of a car that enables a driver to see from an inside the car to an outside of the car. In one implementation, a plane wave or radio signal may be transmitted by the antenna structure 100.

Figure 1B:
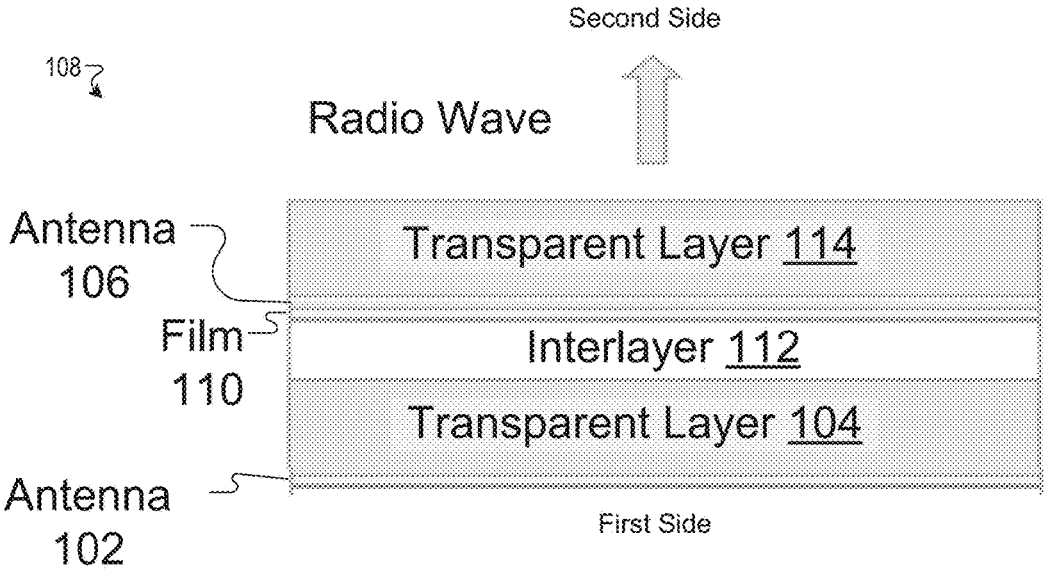
FIG. 1B illustrates an antenna structure that includes the first antenna element, a first transparent layer, an interlayer, a film, the second antenna element, and a second transparent layer, according to an implementation.

FIG. 1B illustrates an antenna structure 108 that includes the first antenna element 102, a first transparent layer 104, an interlayer 112, a film 110, the second antenna element 106, and a second transparent layer 114, according to an implementation. Some of the features in FIG. 1B are the same or similar to the some of the features in FIG. 1A as noted by same reference numbers, unless expressly described otherwise.

The antenna structure 108 may be part of a laminated structure. For example, the laminated structure may be laminated glass, such as safety glass, used in an automobile, aircraft, or skyscraper that holds together when it shatters. For example, in the event that the first transparent layer 104 breaks, the first transparent layer 104 is held in place by the interlayer 112. The interlayer 112 may be a polyvinyl butyral (PVB) material or an ethylene-vinyl acetate (EVA) material that is located between the first transparent layer 104 and the second transparent layer 114. The interlayer 112 bonds the first transparent layer 104 and the second transparent layer 114 together even when the first transparent layer 104 and/or the second transparent layer 114 is broken. For example, the interlayer 112 may prevent the first transparent layer 104 and/or the second transparent layer 114 from breaking up into large sharp pieces of material that may become a hazard.

The antenna structure 108 may also include the film 110. In one implementation, the film 110 may be made of metallic material, metal alloy material, ceramic material, or dielectric material that is an infrared barrier. In another implementation, the film 110 may a transparent layer or substrate impregnated with indium, tin oxides, noble metals, and so forth. The film 110 may be substantially transparent.

In another implementation, the film 110 may be a conductive material that may block at least a portion of the light spectrum, such as an infrared portion of the light spectrum. For example, infrared (IR) light, such as sunlight, may travel through transparent material, such as glass material, plastic material, polymethyl methacrylate material, or acrylic material. The film 110 may reduce an amount of infrared light in the sunlight that travels through the transparent material. The film 110 may also allow a second portion of the light spectrum, such as visible light, to pass through the film.

In one example, a vehicle may include windows to allow a passenger or driver to view the world outside the vehicle. Infrared light from sunlight may pass through the windows and strike interior surfaces of the vehicle. The infrared light may be absorbed by the interior surfaces of the vehicle and cause the interior surfaces of the vehicle to heat up. The film 110 may be applied to the first transparent layer 104, the interlayer 112, or the second transparent layer 114 to absorb or block IR light and reduce an amount of IR light that travels into the interior of the vehicle. The layer that the film 110 is applied to is not intended to be limiting. For example, the film 110 may be applied to a first or second side of the antenna element 102, the first transparent layer 104, the interlayer 112, the second antenna element 106, and/or the second transparent layer 114 to block IR light.

In one implementation, the film 110 may be a coating that may be applied to the first transparent layer 104 or the second transparent layer 114. In one example, the film 110 may be a metallic coating that may be sprayed onto the first transparent layer 104. In another example, the film 110 may be an IR reflective coating that is sputtered onto the first transparent layer 104. In another implementation, the film 110 may be a strip of material that may be applied to the first transparent layer 104. For example, one side of the film 110 may include an adhesive that may be stuck to the first transparent layer 102 by an adhesive. For example, the film 110 may be applied to the first side of the transparent layer 102 or the second side of the transparent layer 102.

In one implementation, the first transparent layer 104 may be 2.1 mm thick, the interlayer 112 may be 0.76 mm thick, the film 110 may be 42 nanometers (nm) thick, and the second transparent layer 114 may be 2.1 mm thick. In one example, a thickness of the first antenna element 102, the second antenna element 106, or the combined thickness of the first antenna element 102 and the second antenna element 106 may range from approximately 2 micrometers (um) to 200 um based on the material of the first antenna element 102 and/or the second antenna element 106, the process of manufacturing the first antenna element 102 and/or the second antenna element 106 (such as printing on a circuit board or stamping the material), a frequency of operation of the first antenna element 102 and/or the second antenna element 106, or a skin depth in the conductive material for first antenna element 102 and/or the second antenna element 106 at the frequency of operation.

In another implementation, a loss tangent of the first transparent layer 104 may be 0.01, a loss tangent of the second transparent layer 114 may be 0.01, and a loss tangent of interlayer 112 may be 0.05. In another implementation, a dielectric constant of the first transparent layer 104 may be 7, a dielectric constant of the second transparent layer 114 may be 7, and a dielectric constant of the interlayer 112 may be 3.

Figure 2:
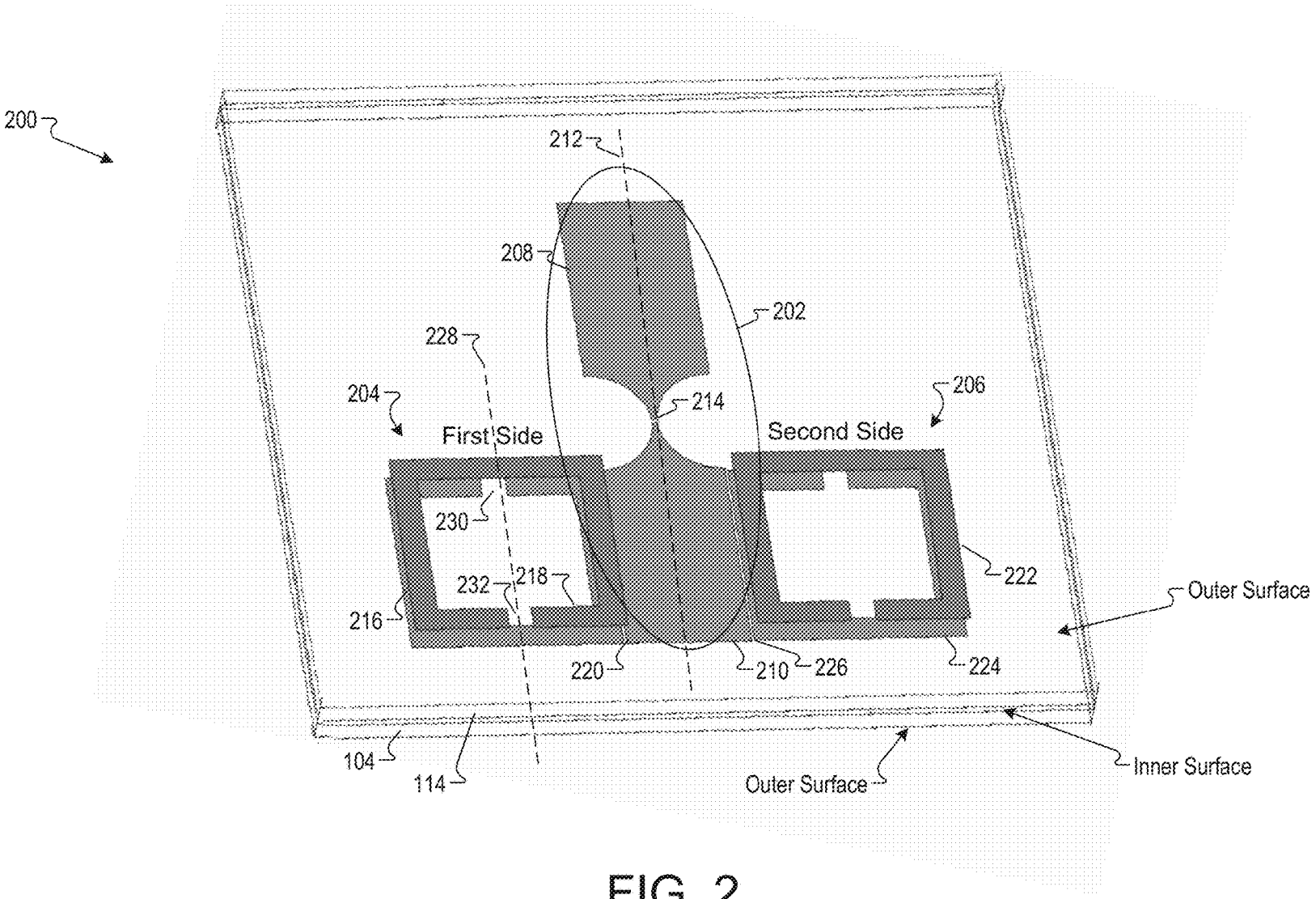
FIG. 2 illustrates an antenna structure that includes a dipole antenna structure, a first split ring resonator, and a second split ring resonator, according to one embodiment.

FIG. 2 illustrates an antenna structure 200 that includes a dipole antenna structure 202, a first split ring resonator 204, and a second split ring resonator 206, according to one embodiment. Some of the features in FIG. 2 are the same or similar to the some of the features in FIGS. 1A and 1B as noted by same reference numbers, unless expressly described otherwise.

The dipole antenna structure 202 may include a first dipole antenna element 208 and a second dipole antenna element 210. The first dipole antenna element 208 and the second dipole antenna element 210 may be substantially similar conductive elements. For example, the first dipole antenna element 208 and the second dipole antenna element 210 may be two halves of the dipole antenna structure 202. In one implementation, the first dipole antenna element 208 may be a metal wire, a rod, and so forth. In another implementation, the first dipole antenna element 208 may be conductive material that is a square shape, a rectangle shape, a circular shape, and so forth. The second dipole antenna element 210 may be the same material and shape as the first dipole antenna element 208. In another implementation, the first dipole antenna element 208 and the second dipole antenna element 210 may be bilaterally symmetrical, where the first dipole antenna element 208 and the second dipole antenna element 210 are located on the same plane and axis 212 and are mirror images of each other.

The dipole antenna structure 202 may be located on an outer surface of the first transparent layer 104. For example, the outer surface of the first transparent layer 104 may be an interior surface of a vehicle windshield and the dipole antennas structure 202 may be located on the interior of the vehicle windshield.

A feed point 214 may be connected to the first dipole antenna element 208 or the second dipole antenna element 210. In one implementation, the feed point 214 may be connected to a center of the dipole antenna structure 202 where the first dipole antenna element 208 and the second dipole antenna element 210 connect. In another implementation, the first dipole antenna element 208 and the second dipole antenna element 210 may be separated by a gap at the feed point 214 where a transmission line is connected to the first dipole antenna element 208 and the second dipole antenna element 210. The feed point 214 may be connected to a transmitter and may drive a current from the transmitter to the first dipole antenna element 208 and the second dipole antenna element 210.

The first split ring resonator 204 may be located on a first side of the dipole antenna structure 202. For example, the first split ring resonator 204 may be located on the first side of the dipole antenna structure 202 approximate to the second dipole antenna element 210. The first split ring resonator 204 may include a first resonating element 216 and a second resonating element 218. The first resonating element 216 may be coplanar to the dipole antenna structure 202 and separated by a gap 220. In one example, a size of the gap 220 may vary in relation to an operating frequency of the dipole antenna structure 202. In another example, a size of the gap 220 may range from approximately 100 um to 500 um. In one implementation, the first resonating element 216 may be approximate to the second dipole antenna element 210. The dipole antenna structure 202 and the first resonating element 216 may be magnetically coupled to an applied electromagnetic field, where the current of the dipole antenna structure 202 induces a current at the first resonating element 216.

The second resonating element 218 may be located on a plane that is parallel to the plane where the first resonating element 216 is located. In one implementation, the second resonating element 218 may be located between the first transparent layer 104 and the second transparent layer 114. For example, the second resonating element 218 may be located between layers of safety glass. The second resonating element 218 may also align with the first resonating element 216 along a z-axis 228 protruding from the transparent layers 104 and 114. In one implementation, the second resonating element 218 may be coated with silver. In another implementation, the second resonating element 218 may be sputtered onto the first transparency layer 104 or the second transparency layer 114 and a portion of the second resonating element 218 may be removed. For example, the portion of the second resonating element 218 may be removed by a laser.

The first resonating element 216 and the second resonating element 218 may be mirror images of each other centered around the z-axis 228 on different planes. The first resonating element 216 and the second resonating element 218 may be enclosed loops with gaps 230 and 232 in them at opposite ends, respectively. In one example, the gap 230 may be a split in the loops where a first end of the first resonating element 216 is separated from a second end by an empty space. In another example, the gap 232 may be a split in the loops where a first end of the second resonating element 218 is separated from a second end by an empty space. With the gaps 230 and 232, the first resonating element 216 and the second resonating element 218 may be C-shaped structures.

In one example, the first resonating element 216 and the second resonating element 218 may be made of nonmagnetic metal, such as copper. The first resonating element 216 and the second resonating element 218 may be magnetically coupled by an applied electromagnetic field between the first resonating element 216 and the second resonating element 218. In another example, as current is feed at the feed point 214, the current flows along the edges of the first dipole antenna element 208 and the second dipole antenna element 210. The magnetic fields traverse the gap 220 between the first and second resonating elements 216 and 218 and the dipole antenna structure 202 to induce a current at first resonating element 216. A magnetic field at the first resonating element 216 induces a current at the second resonating element 218. The current at the second resonating element 218 generates a signal that is transmitted to another device.

The magnetic coupling may be broadside coupling between the first resonating element 216 and the second resonating element 218. For example, the gap 230 of the first resonating element 216 and the gap 232 of the second resonating element 218 may induce a current at the second resonating element 218. In one example, the first split ring resonator 204 may have a phase point that is different than the dipole antenna structure 202.

The first transparent layer 104 may increase an efficiency and gain of the antenna structure 200 by propagating a signal via the magnetic coupling through the first transparent layer 104. For example, the first resonating element 216 and the second resonating element 218 coupling through the first transparent layer 104 may increase a performance of the antenna structure 200 because the magnetic coupling through the glass may have less loss than the radiating of a field through the air. The glass may have less loss because the first transparent layer 104 may act as a substrate for magnetic coupling.

A shape and size of the first resonating element 216 and the second resonating element 218 is not intended to be limiting. For example, the first resonating element 216 or the second resonating element 218 may be a square shape, a circle shape, or other geometric shapes that have a resonant frequency that will couple to the dipole antenna structure 202.

The second split ring resonator 206 may be located on a second side of the dipole antenna structure 202. The second split ring resonator 206 may otherwise have the same structure as the first split ring resonator 206, as discussed above.

The electromagnetically coupled first split ring resonator 204 and second split ring resonator 206 may steer the beam transmitted by the antenna structure 200. In one implementation, the first resonating element 216 and the second resonating element 218 are coupled to the dipole antenna structure 202 to provide the beam shaping of a radiation pattern of the antenna structure 200. For example, the antenna structure 200 may tilt a radiation pattern of the antenna structure 200 downward or upward by approximately 45 degrees, as discussed below.

The type of the antenna and resonators of the antenna structure 200 is not intended to be limiting. For example, rather than a dipole antenna structure, the antenna structure 200 may include a loop antenna that couples two loop-shaped elements that are located between the glass layers.

In one implementation, different frequency resonators may create a wideband or multiband capability for the antenna structure 200. In another implementation, a narrowband or wideband capability of the antenna structure 200 may vary for different shapes and dimensions of dipole antenna structures and split ring resonators. In another implementation, a frequency of a signal may scale with a size of the antenna structure 200. In one example, a size of the antenna structure 200 or elements of the antenna structure 200 may scale with a frequency of operation the antenna structure 200. In another example, the frequency of operation may vary with a thickness of the first transparent layer 104 and/or second transparent layer 114, such as a thickness of glass. In another implementation, the antenna structure 200 may include multiple antennas connected to different transceivers for different frequencies.

Figure 3:
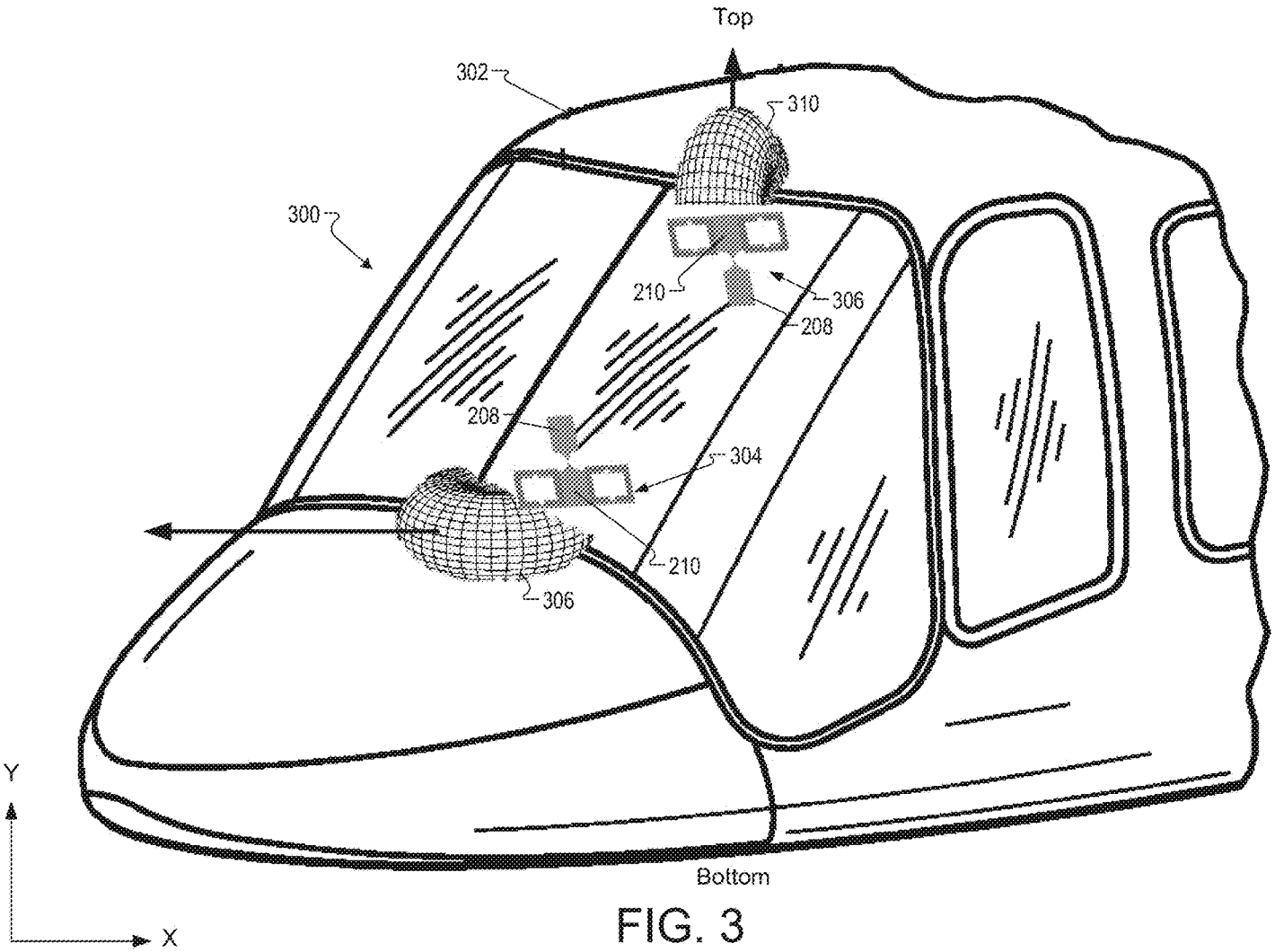
FIG. 3 illustrates a window that includes a first antenna structure and a second antenna structure, according to one implementation.

FIG. 3 illustrates a window 300 that includes a first antenna structure 304 and a second antenna structure 308, according to one implementation. Some of the features in FIG. 3 are the same or similar to the some of the features in FIG. 2 as noted by same reference numbers, unless expressly described otherwise.

In one implementation, the first antenna structure 304 and the second antenna structure 308 may have the same structure as the antenna structure 200 in FIG. 2. The first antenna structure 304 and the second antenna structure 308 may include metamaterial (MM) with defined shapes and sizes that interact with the transmission beams radiated from the first antenna structure 304 and the second antenna structure 308 to shape the beams. The transmission beams of the first antenna structure 304 and the second antenna structure 308 may radiate in all directions on a defined plane, i.e. an omnidirectional radiation pattern.

An orientation of the first antenna structure 304 or the second antenna structure 305 may determine an angle of the plane at which the first antenna structure 304 or the second antenna structure 308 radiates a beam. For example, the first antenna structure 304 may be connected to a first transparent layer 104 and a second transparent layer 114 as in FIG. 2.

The first antenna structure 304 may have a first orientation where the first dipole antenna element 208 may be located above the second dipole antenna element 210 relative to a top of a vehicle 302. The window 300 may be tilted or swept backward at a negative 45-degree angle relative to a Y-axis. When the first antenna structure 304 is in the first orientation, the first antenna structure 304 may shape the beam to radiate at a positive 45-degree angle relative to the angle of the window 300. The positive 45-degree angle of the beam-shaped signal 306 may substantially offset the negative 45-degree angle of the window 300 so that the signal 306 may radiate along the X-axis, e.g., parallel to the ground. In one implementation, the first antenna structure 304 may radiate a signal 306 at an angle that is approximately parallel to the ground when a device connected to the first antenna structure 304 is communicating with a base station or tower. The base station or tower may be a cellular communication tower that is approximately at ground level. For example, a cellular tower may sit on the horizon and may be approximately 200 feet tall. When the signal 306 from first antenna structure 304 radiates at an angle approximately parallel to the horizon, the angle first antenna structure 304 is aligned with the cellular tower.

The second antenna structure 308 may be the same antenna structure as the first antenna structure 304 but with an 180-degree orientation. For example, the second antenna structure 308 may have a second orientation where the first dipole antenna element 208 may be located below the second dipole antenna element 210 relative to a top of the vehicle 302. When the second antenna structure 308 is in the second orientation, the second antenna structure 308 may shape the beam to radiate at a negative 45-degree angle relative to the angle of the window 300. The negative 45-degree angle of the beam-shaped signal 310 may substantially offset the negative 45-degree angle of the window 300 so that the signal 310 may radiate along the Y-axis, e.g., perpendicular to the ground. In one implementation, the second antenna structure 308 may radiate a signal 310 at an angle that is approximately perpendicular to the ground when the device connected to the second antenna structure 306 is communicating with a satellite, such as a cellular communication satellite or a GPS satellite that is approximately perpendicular to the ground.

The offsetting of the signal at a desired angle may improve a performance of the first antenna structure 304or second antenna structure 308 by shaping the beam to be directed in the desired direction. Directing the shaped beam in the desired direction may increase the link margin of the signal and increases a gain of the signal in the desired direction. The link margin may indicate a difference between a sensitivity of a receiver (i.e., the received power at which the receiver will stop working) and an actual amount of power of the signal received at the receiver. For example, a 15 dB link margin means that the receiver may tolerate an additional 15 dB of attenuation between a transmitter and a receiver and still receive the signal without a relatively high bit error rate.

The number of antenna structures connected to the window 300 is not intended to be limiting. For example, a single antenna structure or multiple antenna structures may be connected to the window 300. Additionally, a rotation angle of the first antenna structure 304 and the second antenna structure 308 is not intended to be limiting. For example, the first antenna structure 304 and the second antenna structure 308 may be rotated at different angles to radiate signals at defined angles.

Figure 4:
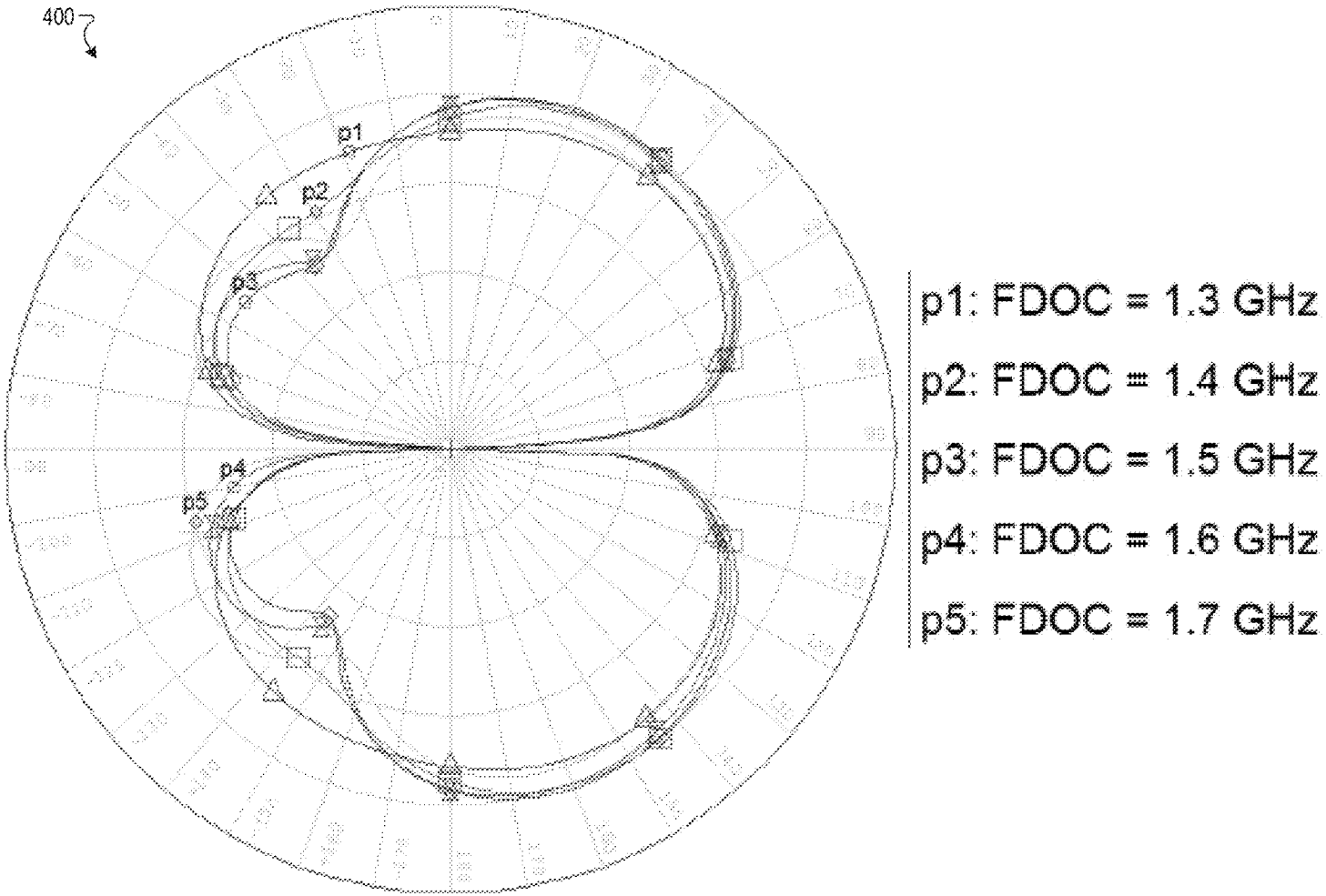
FIG. 4 is a Smith chart of an input impedance of the antenna structure of FIG. 2 according to one embodiment.

FIG. 4 is a Smith chart 400 of an input impedance of the antenna structure 200 of FIG. 2, according to one embodiment. The Smith chart 400 illustrates an impedance and reactance of the antenna structure 200. In particular, the lines p1-p5 corresponds to the antenna structure 200 operating in a frequency range of approximately 1.3 GHz to approximately 1.7 GHz. The line p1 shows a radiation beam pattern for a signal with a frequency of 1.3 GHz. The line p2 shows a radiation beam pattern for a signal with a frequency of 1.4 GHz. The line p3 shows a radiation beam pattern for a signal with a frequency of 1.5 GHz. The line p4 shows a radiation beam pattern for a signal with a frequency of 1.6 GHz. The line p5 shows a radiation beam pattern for a signal with a frequency of 1.7 GHz. The Smith chart 400 also shows that at a 10 to 70-degree range, a power of the signals at frequencies between 1.3 GHz and 1.7 GHz may increase by 3 dB.

Various operations are described as multiple discrete operations, in turn, in a manner that is most helpful in understanding the present disclosure, however, the order of description may not be construed to imply that these operations are necessarily order dependent. In particular, these operations need not be performed in the order of presentation.

The terms "over," "above" "under," "between," and "on" as used herein refer to a relative position of one material layer or component with respect to other layers or components. For example, one layer disposed above or over or under another layer may be directly in contact with the other layer or may have one or more intervening layers. Moreover, one layer disposed between two layers may be directly in contact with the two layers or may have one or more intervening layers. In contrast, a first layer "on" a second layer is in direct contact with that second layer. Similarly, unless explicitly stated otherwise, one feature disposed between two features may be in direct contact with the adjacent features or may have one or more intervening layers. The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims may generally be construed to mean "one or more" unless specified otherwise or clear from context to be directed to a singular form. Moreover, use of the term "an implementation" or "one implementation" throughout is not intended to mean the same implementation or implementation unless described as such. The terms "first," "second," "third," "fourth," etc. as used herein are meant as labels to distinguish among different elements and may not necessarily have an ordinal meaning according to their numerical designation.

It will be appreciated that variants of the above-disclosed and other features and functions, or alternatives thereof, may be combined into many other different systems of applications. Various presently unforeseen or unanticipated alternatives, modifications, variations, or improvements therein may be subsequently made by those skilled in the art which are also intended to be encompassed by the following claims.

What is claimed is:

1. An apparatus comprising:

an antenna;

a first split ring resonator located on a first side of the antenna, wherein the first split ring resonator is magnetically coupled to the antenna, and wherein the first split ring resonator further comprises a first resonating element coplanar to the antenna and a second resonating element located above the first resonating element; and a second split ring resonator located on a second side of the antenna, wherein the second split ring resonator is magnetically coupled to the antenna, and wherein the second split ring resonator further comprises a third resonating element coplanar to the antenna and a fourth resonating element located above the third resonating element.

2. The apparatus of claim 1, wherein the first split ring resonator and the second split ring resonator shape a transmission beam radiated from the apparatus.

3. The apparatus of claim 1, wherein the antenna further comprises:

a first antenna element; and a second antenna element coupled to the first antenna element.

4. The apparatus of claim 1, wherein:

the first resonating element is magnetically coupled to the antenna;

the second resonating element is magnetically coupled to the first resonating element;

the third resonating element is magnetically coupled to the antenna; and the fourth resonating element is magnetically coupled to the third resonating element.

5. The apparatus of claim 1, further comprising:

a first transparent layer with a first side and a second side, wherein:

the first side of the first transparent layer is connected to the antenna, the first resonating element, and the third resonating element; and the second side of the first transparent layer is connected to the second resonating element and the fourth resonating element; and a second transparent layer connected to the second resonating element and the fourth resonating element.

6. The apparatus of claim 5, further comprising an interlayer connected to the second transparent layer, wherein the interlayer absorbs or reflects a portion of a light spectrum.

7. The apparatus of claim 1, further comprising a transparent layer with a first side and a second side, wherein:

the antenna is connected to the first side;

the first resonating element is connected to the first side;

the second resonating element is connected to the second side;

the third resonating element is connected to the first side; and the fourth resonating element is connected to the second side.

8. The apparatus of claim 7, wherein the transparent layer comprises at least one of a glass material, a plastic material, a polymethyl methacrylate material, or a acrylic material.

9. The apparatus of claim 1, wherein:

a first gap separates the first resonating element and antenna; and a second gap separates the second resonating element and antenna.

10. The apparatus of claim 1, wherein:

a first gap separates a first end of the first resonating element and a second end of the first resonating element; and a second gap separates a first end of the second resonating element and a second end of the second resonating element.

11. An apparatus comprising:

a radio frequency (RF) feed;

an antenna structure coupled to the RF feed, wherein the antenna structure comprises:

a dipole antenna comprising:

a first antenna element; and a second antenna element coupled to the first antenna element;

a first split ring resonator, the first split ring resonator comprising:

a first resonating element coplanar to the dipole antenna, the first resonating element magnetically coupled to the dipole antenna; and a second resonating element located above the first resonating element, the second resonating element magnetically coupled to the first resonating element; and a second split ring resonator magnetically coupled to the dipole antenna, the second split ring resonator comprising:

a third resonating element coplanar to the dipole antenna, the third resonating element magnetically coupled to the dipole antenna; and a fourth resonating element located above the third resonating element, the fourth resonating element magnetically coupled to the third resonating element.

12. The apparatus of claim 11, wherein:

the first resonating element is a first C-shaped structure;

the second resonating element is a second C-shaped structure;

the third resonating element is a third C-shaped structure; and the fourth resonating element is a fourth C-shaped structure.

13. The apparatus of claim 11, wherein the first antenna element, the second antenna element, the first resonating element, and the third resonating element are coplanar.

14. The apparatus of claim 11, further comprising a feed point connected to the dipole antenna.

15. An apparatus comprising:

a first transparent layer;

a second transparent layer;

an antenna connected to a first side of the first transparent layer, the antenna to transmit a signal with a radiation pattern;

a first split ring resonator magnetically coupled to the antenna, wherein a first portion of the first split ring resonator is connected to the first transparent layer and a second portion of the first split resonator is connected to the second transparent layer; and a second split ring resonator magnetically coupled to the antenna, wherein a first portion of the second split ring resonator is connected to the first transparent layer and a second portion of the second split resonator is connected to the second transparent layer, wherein the first split ring resonator and the second split ring resonator are to shape the radiation pattern of the signal to transmit at a defined angle.

16. The apparatus of claim 15, wherein:

the first portion of the first split ring resonator is a first resonating element;

the second portion of the first split ring resonator is a second resonating element;

the first portion of the second split ring resonator is a third resonating element; and the second portion of the second split ring resonator is a fourth resonating element.

17. The apparatus of claim 15, wherein the antenna comprises a first dipole antenna element and a second dipole antenna element that are bilaterally symmetrical.

18. The apparatus of claim 17, wherein the second resonating element and the fourth resonating element are laminated between the first transparent layer and the second transparent layer.

19. The apparatus of claim 15, wherein the apparatus is a window of a vehicle, a window of a building, a window in an aircraft, or a visor in a helmet and the defined angle is approximately a 45 degree angle relative to an angle of the window.

* * * * *